United States Patent [19]

Crouch et al.

[11] 4,071,727

[45] Jan. 31, 1978

[54] VACUUM-TYPE CIRCUIT INTERRUPTER WITH MEANS FOR PROTECTING ITS BELLOWS AGAINST MECHANICAL DAMAGE

[75] Inventors: Donald Wayne Crouch, Newtown Square; Robert Wayne Nelson, Broomall, both of Pa.

[73] Assignee: General Electric Company, Philadelphia, Pa.

[21] Appl. No.: 683,869

[22] Filed: May 6, 1976

[51] Int. Cl.[2] ..... H01H 33/66

[52] U.S. Cl. ..... 200/144 B; 200/83 D; 200/146 AA; 267/65 C; 313/146

[58] Field of Search ..... 267/65 C; 277/6, 24, 277/20; 200/144 B, 146 AA, 83 D; 313/146

[56] References Cited

U.S. PATENT DOCUMENTS

| | | | |
|---|---|---|---|
| 2,920,169 | 1/1960 | Jennings | 200/144 |
| 2,943,167 | 6/1960 | Hughes et al. | 200/83 D |
| 2,979,587 | 4/1961 | Jennings | 200/144 |
| 3,036,180 | 5/1962 | Greenwood | 267/65 C |
| 3,087,034 | 4/1963 | Beers | 200/144 B |
| 3,950,628 | 4/1976 | Hruda | 200/144 B |
| 3,969,598 | 7/1976 | Sofianek et al. | 200/144 B |

FOREIGN PATENT DOCUMENTS

| | | | |
|---|---|---|---|
| 51-15095 | 4/1976 | Japan | 200/144 |

*Primary Examiner*—Saxfield Chatmon, Jr.
*Attorney, Agent, or Firm*—William Freedman

[57] ABSTRACT

A guide sleeve for the movable contact rod of a vacuum-type circuit interrupter fits within the usual tubular bellows of the interrupter. The bellows has some of its annular convolutions located axially-inwardly of the axially-inner end of the guide sleeve. A coating of self-lubricating plastic material is provided on the outer peripheral surface of the guide sleeve and on its inner end surface. This coating is sufficiently close to the internal surface of the bellows as to be contacted by said convolutions when the contact rod is axially moved during operation of the interrupter. The lubricating properties of the coating reduce friction between said convolutions and said coated sleeve.

7 Claims, 2 Drawing Figures

VACUUM-TYPE CIRCUIT INTERRUPTER WITH MEANS FOR PROTECTING ITS BELLOWS AGAINST MECHANICAL DAMAGE

BACKGROUND

This invention relates to a vacuum type circuit interrupter that comprises a flexible metal bellows of generally tubular form that acts as a seal around the movable contact rod of the interrupter. The invention relates more particularly to means for protecting this bellows against possible mechanical damage resulting from operation of the interrupter when the bellows has not retained its normal axial symmetry.

In a vacuum-type circuit interrupter, it is conventional to guide the axially movable contact rod by means of a tubular guide that is located within the above-described flexible tubular bellows. Ordinarily, a rather large clearance is provided between the outside of this guide and the inside of the surrounding bellows. The usual bellows applied in a conventional way has an axial symmetry that it retains both when inactive and when compressed or expanded during operation of the interrupter, and this retention of axial symmetry results in maintenance of the relatively large clearance between the guide and the surrounding bellows.

However, in certain vacuum interrupter applications the ordinary flexible bellows does not effectively retain its normal axial symmetry. One such application is where the pressure differential across the bellows is greater than that for which the bellows is normally designed. This relatively large pressure differential causes the bellows to bow slightly, and this bowing can result in interference developing between the bellows and the guide, which interference can mechanically damage the bellows when the interrupter is operated.

SUMMARY

An object of our invention is to protect the bellows against possible mechanical damage resulting from this tendency of the bellows to lose its axial symmetry.

Another object is to provide such protection without necessitating an increase in the diameter of the bellows or without necessitating an increase in the strength of the bellows, such as might be provided by increasing its wall thickness.

In carrying out the invention in one form, we provide a vacuum-type circuit interrupter comprising an evacuated envelope and a contact rod projecting through a wall of the envelope. A flexible metal bellows of generally tubular configuration projects into the envelope and surrounds the contact rod. This bellows contains annular convolutions axially-spaced along its length and has its inner end joined to the contact rod and its outer end joined to the envelope wall. A guide for the contact rod comprises a tubular metal sleeve surrounding the rod, located within the bellows, and fixed to the envelope wall for guiding the rod for axial movement. The sleeve has an inner end wall so located that some of the bellows' convolutions are located axially inwardly thereof.

A coating of self-lubricating plastic material is provided on the outer peripheral surface of the sleeve and on the inner end surface of the sleeve. This coating is sufficiently close to the internal surface of the bellows as to be contacted by said convolutions when the contact rod is axially moved during operation of the interrupter, but the lubricating properties of the coating reduce friction between the convolutions and the coating, thereby protecting the bellows against damage from such contact.

DETAILED DESCRIPTION OF PREFERRED EMBODIMENT

Figure 1:
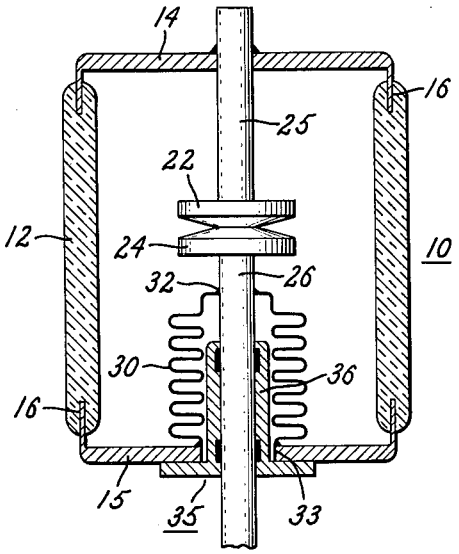
FIG. 1 is a sectional view of a vacuum-type circuit interrupter embodying one form of our invention.

Referring now to FIG. 1, there is shown a vacuum-type circuit interrupter comprising a highly-evacuated envelope 10 comprising a tubular casing 12 of electrical insulating material and two end caps 14 and 15 joined to the casing at its opposite ends by suitable seals 16. Located within the envelope are two relatively movable contacts 22 and 24.

Contact 22 is a stationary contact carried by a stationary contact rod 25 that extends in sealed relationship through the upper end cap 14. Contact 24 is a movable contact carried by a movable contact rod 26 that extends freely through an opening in the lower end cap 15.

For providing a seal about the movable contact rod 26, a flexible metal bellows 30 is provided. This bellows is of a generally tubular form and surrounds the movable contact rod 26. The upper end of the bellows is joined to the movable contact rod at 32, and the lower end is joined to the lower end cap at 33. The bellows is of a conventional form, comprising a thin metal wall of tubular configuration that contains a plurality of annular convolutions 34 axially spaced along its length.

Opening of the interrupter is effected by driving the movable contact rod 26 downwardly from its closed position of FIG. 1 through a short stroke to separate the contacts. Closing is effected by returning the movable contact rod 26 from its open position upwardly into its position of FIG. 1 to reengage the contacts.

Figure 2:
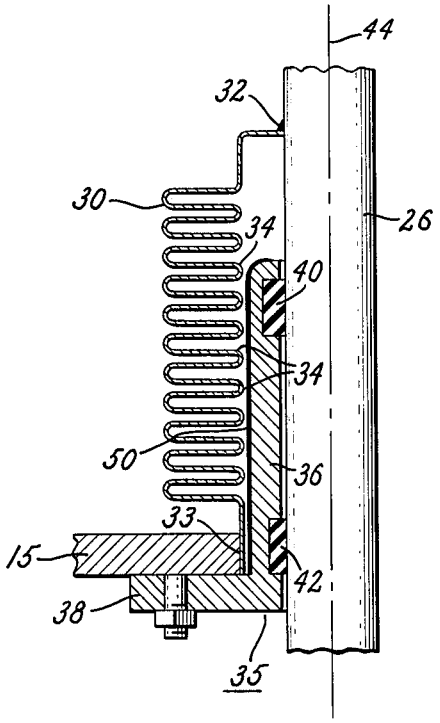
FIG. 2 is an enlarged view of a portion of the interrupter of FIG. 1.

For guiding the movable contact rod 26 during such opening and closing operations, a guide 35 is provided. This guide comprises a tubular metal sleeve 36 surrounding movable contact rod 26 and a radially outwardly extending flange 38 on the lower end of the sleeve fixed to the end cap 15. As shown in FIG. 2, within the sleeve 36 there are two annular bushings 40 and 42 of low-friction material closely surrounding the movable contact rod and forming a slide bearing therefor. A preferred material for bushings 40, 42 is polytetrafluoroethylene, referred to herein as TFE. Such material is available from E. I. DuPont Company under the trademark Teflon.

The bellows 30 is shown as being axially symmetrical about a longitudinal axis 44 which coincides with the central longitudinal axis of movable contact rod 26. The usual bellows when applied under ordinary conditions maintains this axial symmetry both when inactive and during its compression or expansion in the course of an interrupter-operation. Usually a relatively large clearance has been provided between the internal surface of the bellows 30 and the outer surface of guide sleeve 36. This large clearance has usually been maintained without significant reduction during operation of the interrupter because of the above-described ability of the bellows to retain its axial symmetry.

We have found, however, that this clearance can be significantly impaired if the pressure differential across the bellows is above a predetermined value. Under these pressure conditions, the bellows, if its tubular wall is radially unconfined at points intermediate its length, does not retain its axial symmetry. Even though the ends of the bellows are confined, the tubular body, if radially unconfined, can bow into a banana-like configuration. We have found that as a result of such bowing the bellows can be damaged during interrupter-operation, principally as a result of its upper convolutions 34 rubbing on the upper end of the sleeve portion 36 of the guide.

This problem can be overcome by making the bellows larger in diameter (which would usually require an increase in the diameter of the interrupter) or by increasing its wall thickness to strengthen it (which would usually require an increase in the length of the bellows); but we use a less costly approach than either of these and one which requires no increases in the size of the interrupter. More specifically, we employ a guide sleeve 36 that has a larger outer diameter than is typically used with a bellows of a given inner diameter, and we apply to the outer peripheral surface of this sleeve and its axially-inner end surface a thin coating 50 of a self-lubricating material, preferably TFE.

The coated guide sleeve 36, 50 has an external diameter sufficiently large to prevent the convolution 34 of the bellows that surround the sleeve from moving in a radial direction from their normal unstressed position by more than several hundredths of an inch, preferably no more than about 0.03 inches. In other words, the clearance between the inner surface of the convolutions 34 and the outer surface of the coated sleeve is only several hundredths of an inch or less, preferably no greater than about .03 inches. This relatively snug fit restrains the tubular bellows wall against the above-described bowing.

A slight amount of bowing can still occur in the portion of the tubular bellows wall located above the upper end of the guide sleeve, but we limit this bowing by limiting this length as much as feasible. In this respect, the length of the bellows located above the upper end of the guide sleeve when the interrupter is closed is only slightly greater than the value needed to prevent the end of the bellows from contacting the upper end of the sleeve, i.e., a value only slightly greater than the opening stroke of the interrupter plus a small allowance for overtravel at the end of the opening stroke. This usually means that only about 30% of the length of the bellows is located above the upper end of the guide sleeve. In any case, the guide sleeve 36 should be sufficiently long so that less than 50% of the length of the bellows is located above the upper end of the sleeve.

Using a coated sleeve 36, 50 with the above-described relatively large diameter results in the inner surface of convolutions 34 contacting the outer peripheral surface of the sleeve 36, 50, but the TFE coating on the sleeve limits friction between these parts during interrupter-operation to such a low value that there is little or no chance that the bellows will be damaged by such contact during the normal expected lifetime of the interrupter.

The inner end of the sleeve 36 is a rather crucial region since the radially-outer portion of this end will be contacted during opening by any convolutions projecting radially inwardly of the outer peripheral surface of the sleeve. But we materially reduce the chances that the bellows will be damaged by such contact by: (1) rounding this end at its outer edge to reduce interference with the convolutions moving thereby and (2) by locating a portion of the TFE coating 50 in this region to reduce the friction resulting from rubbing of the convolutions on this end.

The above-described coating 50 on the outer surface of the guide sleeve 36 is preferably applied by slipping over the sleeve 36 a snuggly fitting tube of heat-shrinkable TFE and then heating the sleeve and tube to cause the tube to shrink about the sleeve including the rounded end surface. In one form of the invention, the TFE tube has a thickness of 0.02 inches. The resulting coating has the desired qualities of toughness, lubricity, and uniformity.

The guide sleeve 36 is made of metal, preferably steel, so that it has the required mechanical strength to resist transverse displacement of the contact rod 26 under high current conditions. Preferably, the steel is a non-magnetic stainless steel so that it has a low susceptibility to eddy-current heating.

Although our above-described bellows-guide combination is especially suited for use in applications where the bellows may be bowed by large pressure differentials thereacross, it is also useful in applications where lesser pressure differentials are present. If for any reason the bellows is unable to effectively retain its axial symmetry, the above-described features of the guide will cooperate with the bellows to reduce the risk of mechanical damage to the bellows during operation of the interrupter.

While we have shown and described a particular embodiment of our invention, it will be obvious to those skilled in the art that various changes and modifications may be made without departing from the invention in its broader aspects; and we, therefore, intend herein to cover all such changes and modifications as fall within the true spirit and scope of our invention.

What we claim as new and desire to secure by Letters Patent of the U.S. is:

1. A vacuum-type circuit interrupter comprising:

a. an evacuated envelope, b. a pair of relatively movable contacts within said envelope, c. a conductive contact rod projecting through a wall of said envelope and carrying one of said contacts at one end of the rod, d. a flexible metal bellows of a generally tubular configuration projecting into said envelope and surrounding said contact rod, said bellows containing annular convolutions axially-spaced along its length, e. means for joining the inner end of said bellows to said contact rod and for joining the outer end of said bellows to said envelope wall, f. a guide for said contact rod comprising a tubular metal sleeve surrounding said contact rod, located within said bellows, and fixed to said envelope wall for guiding said rod for axial movement, said sleeve having an inner end wall so located that some of said convolutions are located axially inwardly thereof, g. means forming a slide bearing disposed between said sleeve and said contact rod, and h. a coating of self-lubricating plastic material on the outer peripheral surface of said sleeve and on the inner end surface of said sleeve, which coating is sufficiently close to the internal surface of said bellows as to be contacted by said convolutions when said contact rod is axially moved during operation of the interrupter, the lubricating properties of said coating reducing friction between said convolutions and said coated sleeve.

2. The vacuum interrupter of claim 1 in which said inner end wall has a rounded configuration in its radially outer region, said end wall portion of rounded configuration being coated by said plastic material.

3. The vacuum interrupter of claim 2 in which the portion of said coating on said inner end wall contacts convolutions of said bellows moving therepast during an opening operation of said interrupter.

4. The vacuum interrupter of claim 1 in which the pressure differential on opposite sides of said bellows is several atmospheres and so high as to cause bowing of said bellows if radially unrestrained at locations intermediate its ends.

5. The vacuum interrupter of claim 1 in which less than half the bellows length is located beyond the inner end of said guide sleeve when the interrupter is closed.

6. The vacuum interrupter of claim 1 in which only about 30% or less of the bellows length is located beyond the inner end of said guide sleeve when the interrupter is closed.

7. The vacuum interrupter of claim 1 in which said coating of plastic material is made from a tube of heat-shrinkable plastic material fitted about said sleeve.

* * * * *